United States Patent [19]

Huffman

[11] Patent Number: 4,611,637

[45] Date of Patent: Sep. 16, 1986

[54] REED FOR LOOMS

[75] Inventor: Samuel L. Huffman, Greenville, S.C.

[73] Assignee: Carolina Plating Works, Greenville, S.C.

[21] Appl. No.: 746,408

[22] Filed: Jun. 19, 1985

[51] Int. Cl.[4] ..... D03D 49/62

[52] U.S. Cl. ..... 139/192

[58] Field of Search ..... 139/188 R, 192

[56] References Cited

FOREIGN PATENT DOCUMENTS

| | | | |
|---|---|---|---|
| 937130 | 11/1973 | Canada | 139/192 |
| 1306010 | 9/1962 | France | 139/192 |
| 2045817 | 11/1980 | United Kingdom | 139/192 |

*Primary Examiner*—Henry S. Jaudon

*Attorney, Agent, or Firm*—B. P. Fishburne, Jr.

[57] ABSTRACT

The top extrusion cap for a reed used in high speed looms is strengthened to resist bending without adding additional weight to the extrusion cap by the addition of longitudinal stiffening ribs to the opposite sides of the top extrusion cap.

1 Claim, 4 Drawing Figures

FIG. 1
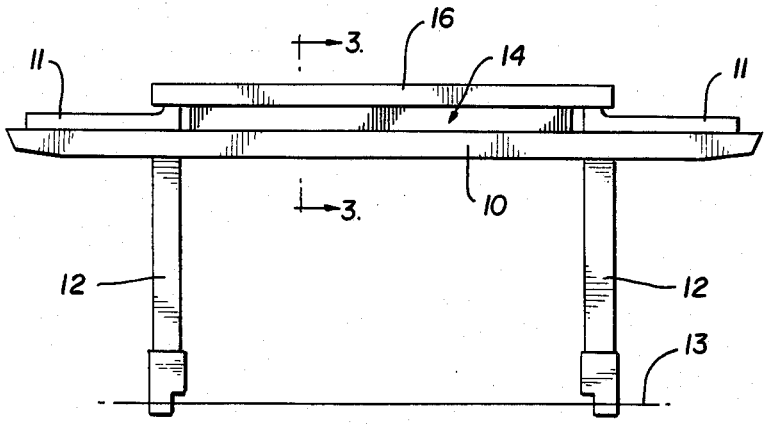
FIG. 2
PRIOR ART
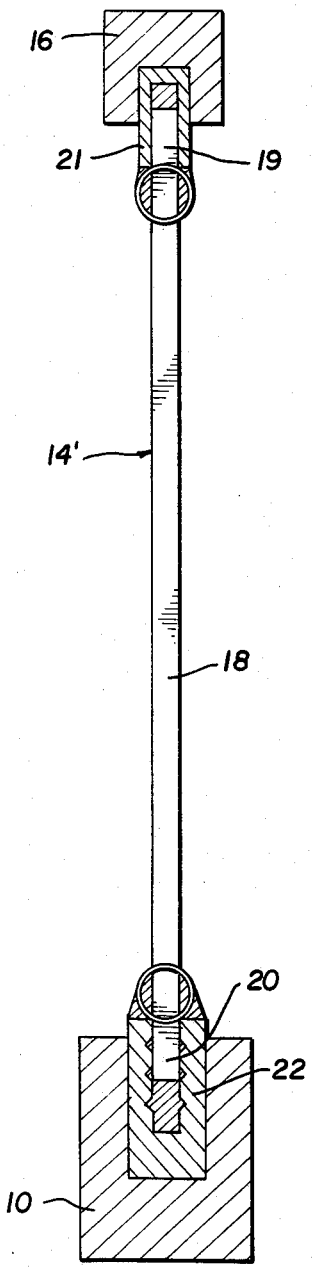
FIG. 3
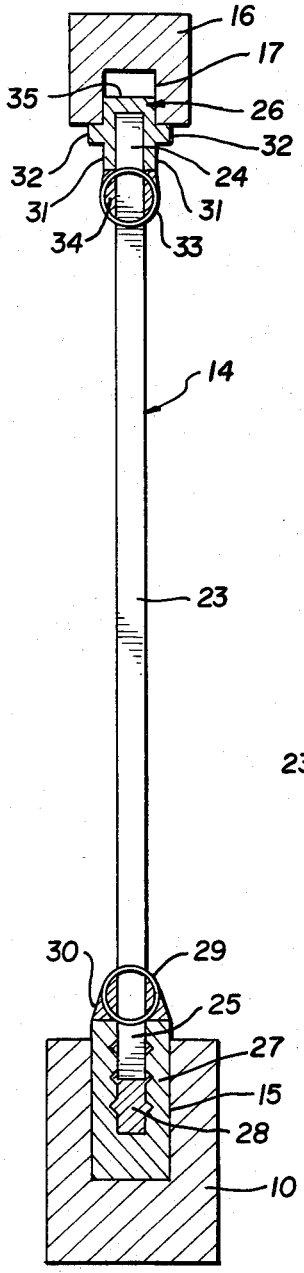
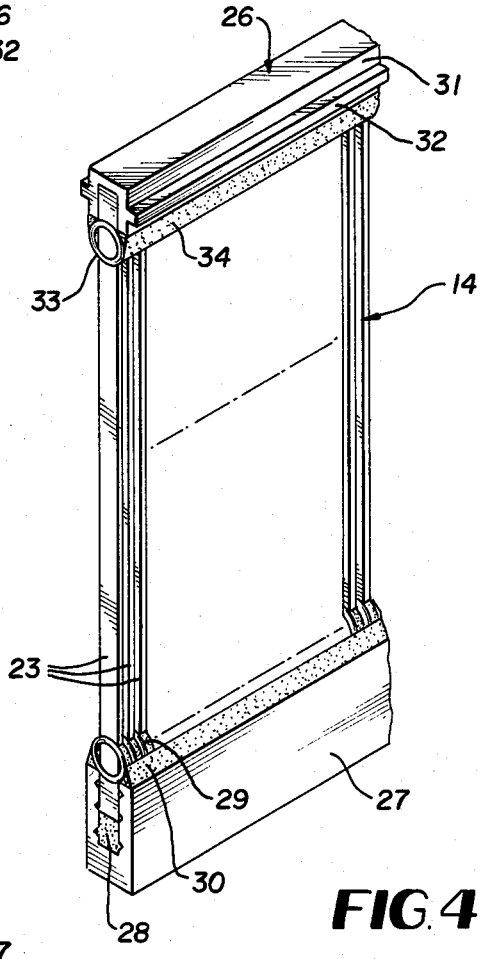
FIG. 4

REED FOR LOOMS

BACKGROUND OF THE INVENTION

Modern high speed sophisticated looms induce bending stresses in the conventional long reed spanning the lay beam of the loom, as a result of which stresses the reed may not remain straight during the operation of the loom, thereby causing serious problems.

The objective of the present invention is to solve this problem of reed bending in high speed looms by strengthening the top extrusion cap of the reed to better resist bending without adding additional weight to the top extrusion cap. As a result of the strengthening of the top extrusion cap of the reed without the addition of weight to the cap, inertia forces acting on the top extrusion cap in high speed looms are not increased and therefore the problem of bending is effectively solved.

In accordance with the present invention, the top extrusion cap of the reed is formed of aluminum to minimize weight and the cap is shortened in the direction extending radially of the lay beam rocker shaft and lay swords. To compensate for this shortening of the top extrusion cap, longitudinal stiffening ribs are provided along the opposite side walls of the top extrusion cap which effectively resist bending of the cap and reed without adding additional weight to the structure.

Other features and advantages of the invention will become apparent to those skilled in the art during the course of the following detailed description.

BRIEF DESCRIPTION OF THE DRAWINGS

FIG. 1 is a side elevation of a loom lay beam and associate equipped with an improved reed according to the present invention.

FIG. 2 is a transverse vertical section taken through a standard reed according to the prior art.

FIG. 3 is a similar section taken on line 3—3 of FIG. 1.

FIG. 4 is a fragmentary perspective view of the improved reed according to the present invention.

DETAILED DESCRIPTION

Referring to the drawings in detail wherein like numerals designate like parts, a conventional loom includes a lay beam 10 having shuttle boxes 11 mounted on its opposite ends, the lay beam being carried by swords 12 which are swingable in unison on a rocker shaft axis 13 parallel to the lay beam 10. A reed 14 forming the subject matter of the present invention spans the lay beam 10 between the shuttle boxes 11 and is held in a longitudinal groove 15 of the lay beam offset from corresponding sides of the shuttle boxes. A reed cap 16 mounted on and moving with the lay beam structure has a groove 17 receiving the top of the reed 14 in accordance with conventional practice.

In the prior art typified by FIG. 2 of the drawings, a reed 14' contains a multiplicity of closely spaced parallel flat wires 18 whose top and bottom end portions 19 and 20 are received in top and bottom extrusion caps 21 and 22 which may be formed of aluminum or steel, in some cases. The use of steel particularly for the top cap 21 is not desirable on any modern high speed loom because of the weight of steel and the resulting increase in inertial forces generated by this weight.

In the prior art construction, even where the top extrusion cap 21 is formed of aluminum to reduce its weight and inertia on a high speed loom, a serious problem arises due to the tendency of the long reed to bend as a result of stresses induced by the high speed motion of the modern loom. If the top cap 21 is formed of steel, it may remain straight during operation but the aforementioned additional weight and inertia problem is still present. Thus, a dilemma is presented in connection with the prior art standard reed and it is this dilemma which the present invention seeks to overcome or solve in accordance with its main objective.

Referring to FIGS. 3 and 4 of the drawings showing the improved reed 14, the flat wires 23 of the reed 14 have their end portions 24 and 25 held in top and bottom extrusion caps 26 and 27, both formed of aluminum. The bottom extrusion cap 27 is substantially conventional and comprises a flat rectangular cross section channel member whose cavity may be filled with epoxy 28 or the like to anchor the wire end portions 25 firmly. In accordance with common practice, the wire end portions are maintained spaced by a coil spring 29 extending along the top of the bottom extrusion cap 27 and also being embedded in epoxy 30 to form a rigid structure.

In accordance with this invention, the two side walls 31 of the top aluminum extrusion cap 26 are foreshortened on the longitudinal axes of the wires 23 which extend radially of the rocker shaft axis 13. This foreshortening reduces the weight of the top extrusion cap. To strengthen the top cap against bending during operation of the high speed loom, two continuous parallel longitudinal strengthening ribs 32 are provided on the exteriors of the side walls 31 substantially at the center of the top extrusion cap 26 with respect to its axis along the wires 23. These ribs 32 enable the top extrusion cap to resist bending in the planes occupied by the side walls 31 during high speed loom operation, and the provision of the ribs 32 does not increase the weight of the top aluminum extrusion cap 26, which weighs no more than the prior art cap 21, but is a great deal more resistant to bending.

The end extensions 31 of the wires 23 are anchored in the top extrusion cap 26 by epoxy or the like and a top coil spring 33 is utilized to maintain the proper spacing of the wires 23 at their tops. The spring 33 is also embedded in epoxy 34.

The foreshortened and rigidified top extrusion cap 26 may engage in the existing groove 17 of the loom reed cap 16, FIG. 3, while the strengthening ribs 32 abut the lower face of the cap 16. In new installations, the groove 17 can be made shallower so that there will be no cavity at the end wall 35 of the top extrusion cap 26.

It may be seen that the improved top extrusion cap allows the use of a light metal, such as aluminum in lieu of steel, to lessen weight and inertia. The resulting loss of bending strength along the length of the reed is regained by providing the ribs 32 and the presence of these ribs does not increase the overall weight of the top extrusion cap. Therefore, the invention solves the dilemma of the prior art in a very simple, economical and practical manner.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A reed particularly for high speed looms comprising a multiplicity of closely spaced parallel equal length reed wires, a bottom reed cap receiving and anchoring corresponding end portions of the reed wires and adapted to engage in and be held by a groove of a lay beam, and a top reed cap formed of light metal and receiving and anchoring top end portions of said reed wires and adapted to engage in and be held by a groove of a loom reed cap and by the bottom face thereof, said top reed cap having a length measured along the longitudinal axes of the reed wires which is substantially less than the length of the bottom reed cap measured along the axes of said wires, the top reed cap being provided on the opposite sides thereof with a pair of external substantially square cross section stiffening ribs whose top faces abut the bottom face of said loom reed cap on opposite sides of the groove of the loom reed cap, said stiffening ribs projecting equidistantly from the opposite sides of the top reed cap and being located substantially at the center of said opposite sides of the top reed cap.

* * * * *